US005433063A

United States Patent [19]

Kovacs et al.

[11] Patent Number: 5,433,063

[45] Date of Patent: Jul. 18, 1995

[54] SEALING SYSTEM AND PROCESS FOR PACKAGING MACHINE

[75] Inventors: Lloyd Kovacs, Sheboygan, Wis.; Mario Tosetti, Bergamo, Italy

[73] Assignee: Hayssen Manufacturing Company, Sheboygan, Wis.

[21] Appl. No.: 54,619

[22] Filed: Apr. 29, 1993

[51] Int. Cl.[6] ..... B65B 9/06

[52] U.S. Cl. ..... 53/550; 53/374.5

[58] Field of Search ..... 53/450, 451, 413, 550, 53/551, 552, 553, 554, 555, 134.1, 373.9, 374.5

[56] References Cited

U.S. PATENT DOCUMENTS

| | | | |
|---|---|---|---|
| 3,815,313 | 6/1974 | Heisler | 53/413 |
| 3,955,338 | 5/1976 | Winzeler et al. | 53/550 X |
| 4,249,364 | 2/1981 | Kawasaki et al. | 53/550 |
| 4,305,240 | 12/1981 | Grevich et al. | 53/550 X |
| 4,450,669 | 5/1984 | Rapparini | 53/554 X |
| 4,525,977 | 7/1985 | Matt | 53/550 X |
| 4,546,595 | 10/1985 | Yasumune et al. | 53/550 X |
| 4,625,495 | 12/1986 | Holovach | 53/550 X |
| 5,109,654 | 5/1992 | Suga | 53/550 X |
| 5,177,935 | 1/1993 | Jones et al. | 53/550 X |
| 5,220,771 | 6/1993 | Burns | 53/551 |

*Primary Examiner*—Horace M. Culver

*Attorney, Agent, or Firm*—Lee, Mann, Smith, McWilliams, Sweeney & Ohlson

[57] ABSTRACT

A system and process for sealing collections of rolls in a bundle. The rolls, which can be multiply packaged rolls or individually packaged or unpackaged rolls, are accumulated and conveyed until they are aligned and then collected in a group. Successive groups are then inserted in a tube of film which is severed and sealed about each group to complete a bundle. The sealing system includes at least two sealing axes, with each axis having at least one die set. The axes are synchronized and individually driven at variable velocities during their paths of travel.

44 Claims, 9 Drawing Sheets

SEALING SYSTEM AND PROCESS FOR PACKAGING MACHINE

BACKGROUND OF THE INVENTION

This invention relates to packaging machinery, and in particular to a system for processing a group of items and sealing them in a plastic film as the items follow a path of travel.

The invention is directed to horizontal form, fill and seal machinery, and particularly that type of machinery in which items to be packaged are enveloped in a plastic film. Other applications of the invention are possible, however.

The heart of a form, fill and seal machine is the sealing apparatus. No matter how quickly items to be packaged might be collected and grouped, it is imperative that they be fully sealed in a package that will not inadvertently open, which is as tightly sealed as desired, and which has all graphics properly displayed and aligned in the packaging material.

The first horizontal form, fill and seal machine was developed by Sam Campbell of Hudson Sharp Company, Green Bay, Wis. in the late 1940's. This machine consisted of a product infeed conveyor, a horizontal forming shoulder for enveloping items within a packaging material, a rotary back seam sealing device which acted as the prime mover for the film, and horizontally rotating sealing bars which both sealed and crush cut the wrapping material. This machine was designed for high speed overwrapping of candy bars and the like, and became known in the industry as the "Campbell Wrapper".

When the Campbell Wrapper was developed, wrapping materials prevalent at the time were heat sealing cellophane and heat seal paper using nitrocellulose coatings as the heat seal medium. It was well known at the time, and is still well known, that in order to obtain a good heat seal, three fundamental criteria must be present—time, temperature and pressure. Without these three criteria in the right proportions, efficient heat sealing cannot be obtained. As early as the 1930's, the DuPont Company, the inventors of heat sealable and moisture proof cellophane, evolved a testing method utilizing time, temperature and pressure in order to provide a standard against which the integrity of heat seals is measured.

With the introduction of polyethylene and other plastic films, the same criteria remain true at the present time. However, because heated plastics lose their structural integrity, cooling must also be a factor in the formula.

One of the most important speed inhibiting factors of the Campbell Wrapper was the very short sealing or dwell time utilized for sealing of the wrapping material. The single rotating horizontal sealing heads of the Campbell Wrapper have their surfaces curved in order to maintain sealing contact. This requires that the time that the sealing heads are in contact with the wrapping material is very short. As a result, the short dwell time has been compensated for by relatively high unit pressure and high temperatures.

Longer dwell times with lower temperatures was a goal constantly sought. Several attempts were made to overcome the short dwell time problem of the Campbell Wrapper, and in the late 1950's or early 60's, a system was developed utilizing multiple heat sealing jaws located on top and bottom chains, the pitch of the sealing jaws being equal to the finished length of the package. This added substantial dwell time, and in fact produced an improved Campbell Wrapper having very high speed. However, due to the configuration of this improvement, in order to change a finished package length, the entire top and bottom sealing systems had to be replaced with a different set of sealing jaws on different chains with the appropriate pitch to coincide with the new package length. While machines of this type were made, the difficulties of changing from one size to another were a severely inhibiting factor.

Another attempt to increase dwell time was to include two horizontal sealing heads in a machine, the first sealing head imparting a "preheat" and the second sealing head adding additional heat and severing the material. Although this configuration did increase speed somewhat, the additional dwell time achieved was marginal.

A further attempt to increase dwell time was to have an individual sealing die close, move in the direction of the film for a short distance, open and then return to the ready position for the next seal. Yet another system developed had rotating dies operating in a "D" motion with the flat side of the D being the dwell. In all cases where dwell time was extended on a single die machine, the mechanics of the systems have been speed inhibiting, and at the most give a dwell time of 50% of an individual package making time, i.e. at 60 per minute the maximum dwell time would be 500 milliseconds.

The first multi-die machine, with the ability to maintain the flexibility of being able to change over easily from one package to another, was designed in the late 1950's by the Cloud Corporation, Chicago, Ill., and was patented. The Cloud patent was subsequently purchased by The Hayssen Manufacturing Company, the assignee of the present application. Hayssen still manufactures equipment covered by the Cloud patent. The Cloud device consists of a series of hinged sealing dies which are slidably mounted on a drum, each die having a mechanism for allowing it to either slide on the drum or grip and travel with the drum. In practice a series of the dies are backed up with the foremost die being stationary in the 12 o'clock position. A release mechanism, operated by a signal from either the product itself in the case of an unprinted film or by a registration mark on the film when proper orientation of graphics is necessary, releases a die which grips the drum and rotates with the drum. The hinged top die closes and is held under pressure while the sealing and cutting takes place. At a speed of 60 packages per minute and a package length of approximately 8 inches, up to 5 seconds of dwell time is achieved compared to something less than 250 milliseconds on a standard Campbell Wrapper machine.

Another phenomenon in horizontal form, fill and seal packaging machines must also be considered. This is the pitch length of the product in the unclosed tube of packaging material verses the finished package length. This is due to the fact that as the packaging material is collapsed between succeeding products or groups of products in the tube, the distance between the products must be reduced in order to obtain a seal, or else the packaging material is stretched and quite probably weakened or damaged. In order to obtain a very tight package, the distance between items in the tube being sealed is one product height plus the width of the sealing bar. Thus, as the product height increases, the differential between the length of pitch between items in the tube and the finished package length becomes greater and greater.

This phenomenon is not a problem in a Campbell Wrapper, which has only a single die, since only one seal and cut is made at a time. Therefore, a package being sealed and cut can change velocity without restraint during the sealing and cutting operation. However, whenever multiple dies are in contact with the film, and where these multiple dies are operated at a constant velocity in a single drive, this phenomenon is accommodated by having the collapsing sealing head pull excess film from downstream. This results in a jerking motion of the film, and is an undesirable characteristic, particularly where several products are simultaneously being packaged within the tube. The incoming film must therefore operate at a variable velocity.

Cassoli U.S. Pat. No. 4,679,379 is directed to a horizontal form, fill and seal machine for packaging of large bundles of toilet tissue and household towels. This machine has single dies with product being intermittently fed through the sealing and wrapping area and intermittently discharged. However, the apparatus has a single die and intermittent operation, therefore resulting in fairly slow operation. The maximum speed touted for a Cassoli-type system is 12 packages per minute, although slower speeds are normally attained.

The system of the present invention overcomes all problems of the prior art by having two or more independently driven die carrying systems (axes) with each axis having one or more die sets. This provides significant advantages:

1. Extremely long dwell times are permitted, allowing the appropriate heating and cooling required for high speeds.
2. The incoming product and film are driven at a constant velocity, with the individual sealing dies slowing to the point of closure on the film in order to accommodate the change in pitch between the products being sealed. All dies downstream of the closing die follow the speed of the closing die. Thus, there is constant velocity of the film and product to the first sealing die, and then variable velocity from then on during the sealing process. The upstream film is not stretched or jerked by such a process.
3. Speeds of 45 packages per minute are attainable in a system according to the invention having three die sets in contact with the film at any one time, while providing 4 seconds of sealing and cooling time, more than adequate to obtain a seal of proper strength and integrity.

Because the dies of the invention have a variable velocity which can be programmed, the multi-axis, multi-die design of the present application is not confined to traditional horizontal form, fill and seal machines. For example, the concepts of the present application can be employed in sealing machines using two rolls of film, one roll above and one roll below a conveying plane, where heat sealing jaws seal the films together to form a curtain of film. In such apparatus, the product or products to be packaged are pushed through the curtain of film and the sealing dies come together to seal and cut, forming another curtain and also completing the package at the same time. Very often such packages are wrapped in a shrink film and then sent through a shrink tunnel. The concepts of the present application can be employed to increase considerably the speed of this type of machine.

SUMMARY OF THE INVENTION

The invention pertains to an apparatus for packaging items and sealing plastic film between successive items. It includes a multi axis system comprising at least two processing axes, each axis having at least one die set, and each die set of each axis being in constant contact with the film between items during the processing. Preferably, there is at least one additional die set per axis, therefore resulting in two die sets per processing axis. The die sets of each axis are spaced equidistant from one another.

Each axis is driven independently of each other axis. In the preferred form of the invention, each die set comprises two opposing half dies, each half die being fully separable from the other half die. Two pairs of belts are provided for driving each axis, one pair of belts being drivingly connected to one half die of each die set, and the other pair of belts being drivingly connected to the other half die of each die set. A transmission means for driving all belts of a processing axis is provided. A first rotatable shaft interlinks one of the belt pairs, and a second rotatable shaft interlinks the other of the belt pairs. The transmission means comprises a propulsion belt which is drivingly engaged on the two shafts to drive the shafts, and therefore all belts, in unison.

In accordance with the preferred form of the invention, three processing axes are employed. Means is provided for synchronizing the axes such that the die sets of the axes are concatenated and are spaced a predetermined distance during processing. Typically, the driving means for each axis is connected to a central computer or processor, which sequentially activates the axes to achieve this result.

In accordance with the preferred form of the invention, the packaging film is in the form of an elongated sheet. The invention includes means for forming the film into a tube in the path of travel of the items being packaged. Preferably, forming is accomplished by a forming shoulder which extends about the path of travel of the items being packaged. Means is provided for inserting items into the tube, that means preferably comprising a series of separate, drivingly interconnected endless parallel belts. The belts have lengths to conform to the shape of the forming shoulder, and therefore each of the belts may have a length different from its neighbor. However, all belts are driven at the same surface speed.

When the tube is formed from the plastic film, it is formed with a longitudinal lap of the film. Means is provided for sealing the longitudinal lap, that means preferably comprising a source of hot air positioned adjacent the longitudinal lap. Also, because the sealing dies collapse the film tube between succeeding groups of items, excess film must be gathered during the sealing process. The invention includes means for tucking the film to form gussets between items as the half dies of each die set are closed on the tube. The tucking means is located on opposite sides of the tube, and includes an air nozzle on either side, each nozzle being directed toward the tube to tuck the film as the half dies close.

As the dies close, the volume inside the tube diminishes as the plastic film collapses about the items being wrapped. However, air can also be trapped inside the tube. Therefore, the invention includes means for reducing the volume of air in the tube. Preferably, this means comprises a conduit extending within the tube which has an inlet at one end of the tube. A vacuum source is connected to the conduit to withdraw excess air from the tube as the sealing dies close.

Each die set comprises two opposing half dies extending laterally across the plastic film. Each half die includes spaced means for clamping the plastic film, and sealing means which extends across the film. In addition, one of the half dies includes means for severing the film when the film is captured between the closed half dies. If desired, the half dies can also includes means for forming a handle in the plastic film so that the finished package can be readily transported.

The processing system according to the invention is divided into an infeed section and a downstream sealing section through which items and the plastic film pass. The plastic film is collapsed between the infeed section and the sealing section as the dies close. The film and encapsulated items are driven at a constant velocity in the infeed section, and are propelled at a variable velocity in the sealing section.

In accordance with a process according to the invention, items having a given height are sealed within a film by die sets, each comprising a pair of the die halves having a given width. First, an item (or group of items) to be sealed is introduced into the film at a first velocity with the film encompassing the item. The item and film are conveyed at the given first velocity. The speed of the item and the film is then changed to a second velocity. At that time, a second item is introduced into the film with the film encompassing the second item. The film bridges both items, and the items are spaced a distance substantially equal to the sum of the height of the items plus the width of the half dies. The second item and the film encompassing the second item are conveyed at the first velocity while the film is simultaneously closed between the die halves. The velocities are related such that when the die halves are fully closed, the items are spaced a distance substantially equal to the width of a half die. When the die halves closer the speed of the second item is then changed to the second velocity, and the film between the die halves is sealed and severed. The process is repeated for third and ensuing items, resulting in a tight package enveloping each item.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
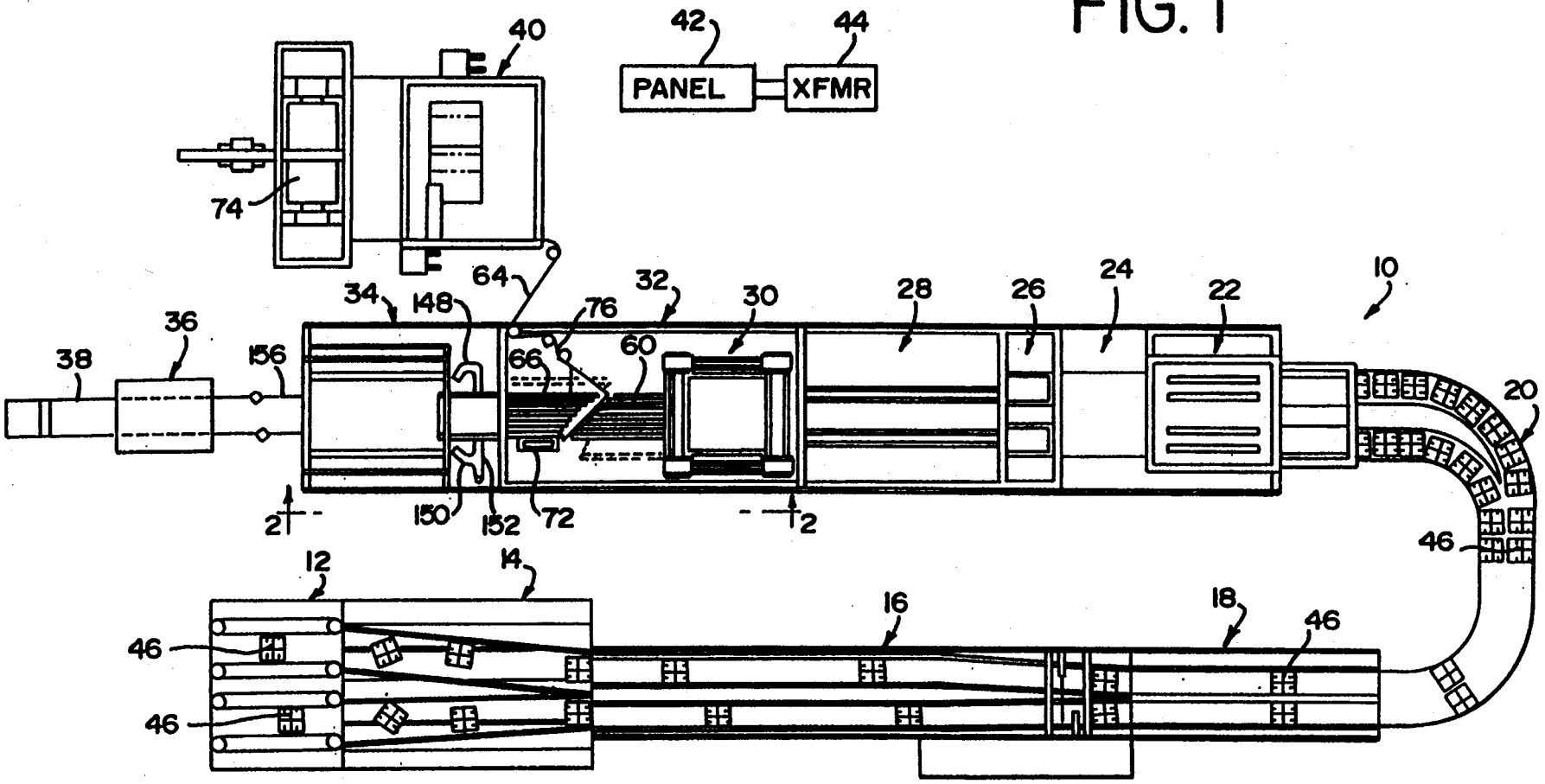
FIG. 1 is an overall schematic view of one form of a complete packaging and sealing apparatus, including the sealing system according to the invention.

A machine employing the sealing system and process according to the invention is shown generally at 10 in FIG. 1. The machine 10 consists of many sections or portions which may be included in a sealing apparatus, and which may be conventional and which are therefore not described in greater detail with the exception of those portions in proximity to the sealing system. The machine 10 in turn is supplied at its inlet end with the products or items to be sealed from what may be a conventional source of such products (not illustrated). From its inlet end, the machine 10 consists of an initial choke belt arrangement 12 for gathering the products, followed by a roll core turning and roll-up section 14 for changing product orientation. Next is a diverter conveyor 16 which diverts product into desired lanes, followed by a short conveyor 18, which is followed by a further elongated conveyor 20 which shifts the flow direction of the product from left to right in the lower portion of FIG. 1 to right to left in the upper portion of FIG. 1. The conveyor 20 is followed by a top choke belt arrangement 22 for accumulating product and which leads to a transfer chute 24. Next in line are synchronization flights 26, followed by an upender section 28. Next is the accumulation section 30, followed by a forming shoulder 32 leading to a sealing section 34 according to the invention. Finally, fully wrapped and accumulated product exits the apparatus 10 to a case doubler 36 and then to an outlet conveyor 38. Plastic film is fed to the forming shoulder 32 from a film handling apparatus 40, and general control of the machine 10 is via a control panel 42 which may include a computer or other process control. Power to the machine 10 is transformed through a voltage transformer 44 in a conventional fashion.

An item 46 to be packaged enters the machine 10 at the choke belt arrangement 12, from whence it is turned, diverted, conveyed, synchronized, upended and accumulated before being packaged in the sealing section 34. In the particular illustration of the drawing figures, the item 46 comprises four rolls of paper, such as toilet tissue. A multiplicity of the items 46 are ultimately packaged in a single package in the sealing section 34. Just as easily, single rolls of toilet tissue, or larger rolls, such as paper towels, can be handled and packaged by the apparatus of the invention.

Figure 3:
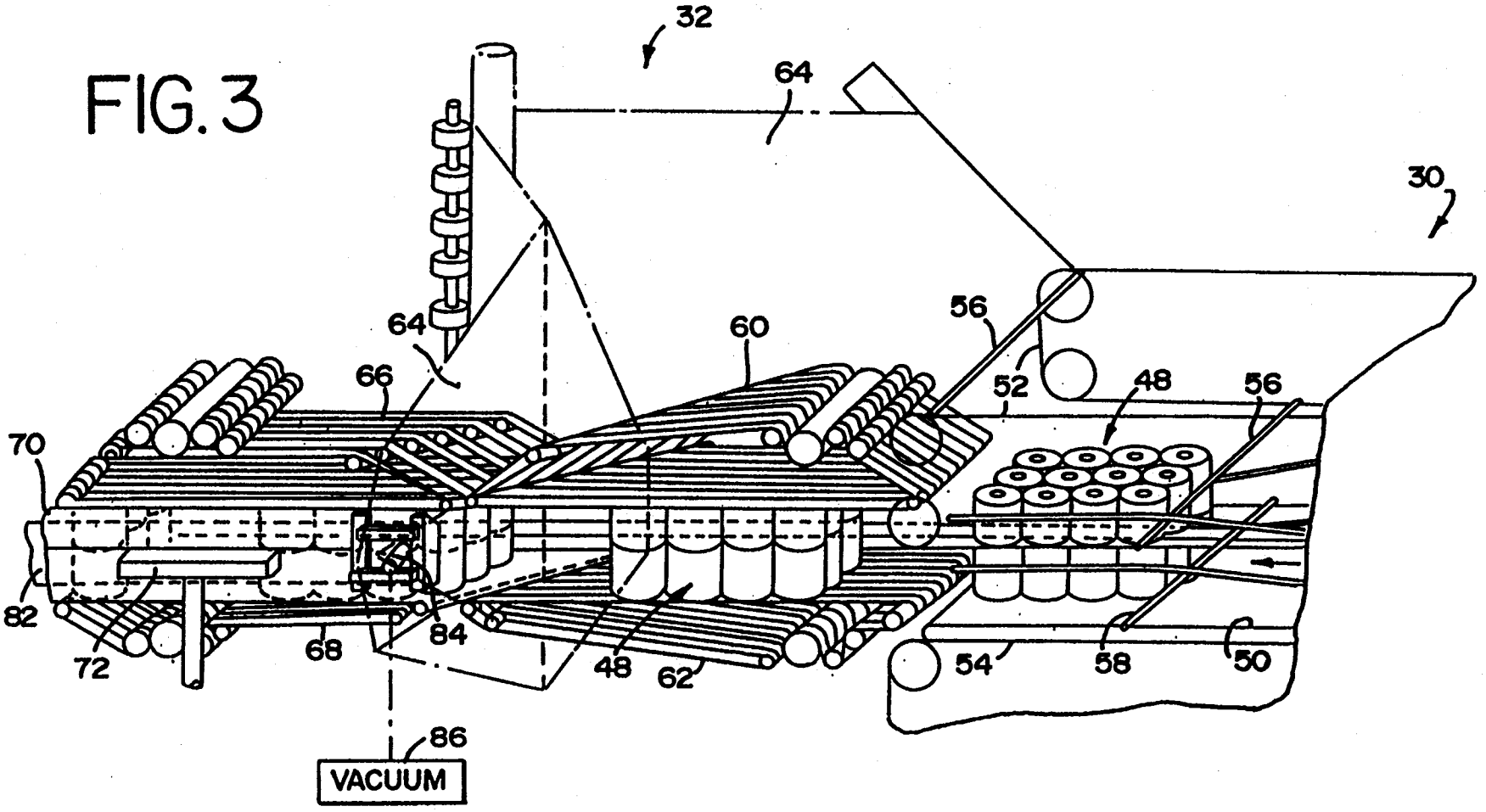
FIG. 3 is a perspective view of a portion of the invention from an accumulating flight through a lap sealer, where the tube formed from plastic film is longitudinally sealed.
Figure 4:
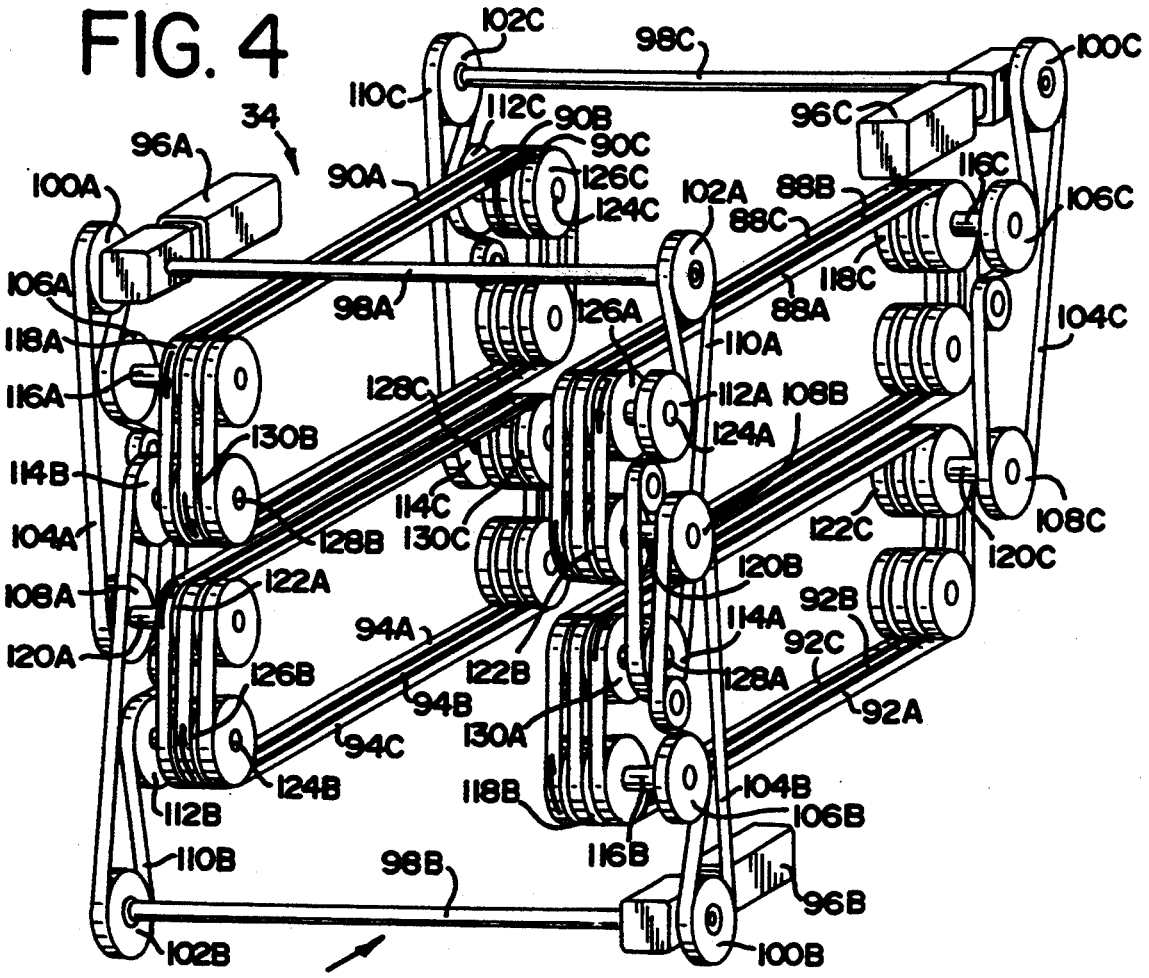
FIG. 4 is a perspective view of the three flights of the sealing system, including the means for driving the flight, but excluding the pairs of half dies for each flight in order to illustrate detail.

The items 46, after travelling through the machine 10, reach the accumulation section 30 shown partially in detail in FIG. 3. There, a predetermined number of the items 46 is accumulated as a group 48 on a dead plate 50

(FIG. 3). Synchronized top and bottom accumulation conveyors 52 and 54, having respective accumulation flights 56 and 58, convey the groups 48 across the dead plate 50 to the forming shoulder section 32. The flights 56 and 58 are appropriately spaced, and the conveyors 52 and 54 are driven at an appropriate speed, in order to accumulate a desired quantity of the items 46 into a group 48. While groups of items four deep and three wide are shown accumulated in the accumulation section 30, it will be evident that adding or subtracting the number of the flights 56 and 58 attached to the conveyors 52 and 54 can change the number of items conveyed as a group 48 to the forming shoulder 32.

A group 48 enters the forming shoulder 32 between an upper segmented conveyor 60 and a lower segmented conveyor 62. The conveyors 60 and 62, and all segments thereof, are driven in unison so that the groups 48 remain as such. The conveyors 60 and 62 are segmented as a series of parallel pull belts so that unused portions of the conveyors 60 and 62 can be removed from service as desired. In addition, the pull belts of the conveyors 60 and 62 are of different lengths to accommodate the angular disposition of the form of the forming shoulder, as best shown in the top view of FIG. 1.

Figure 2:
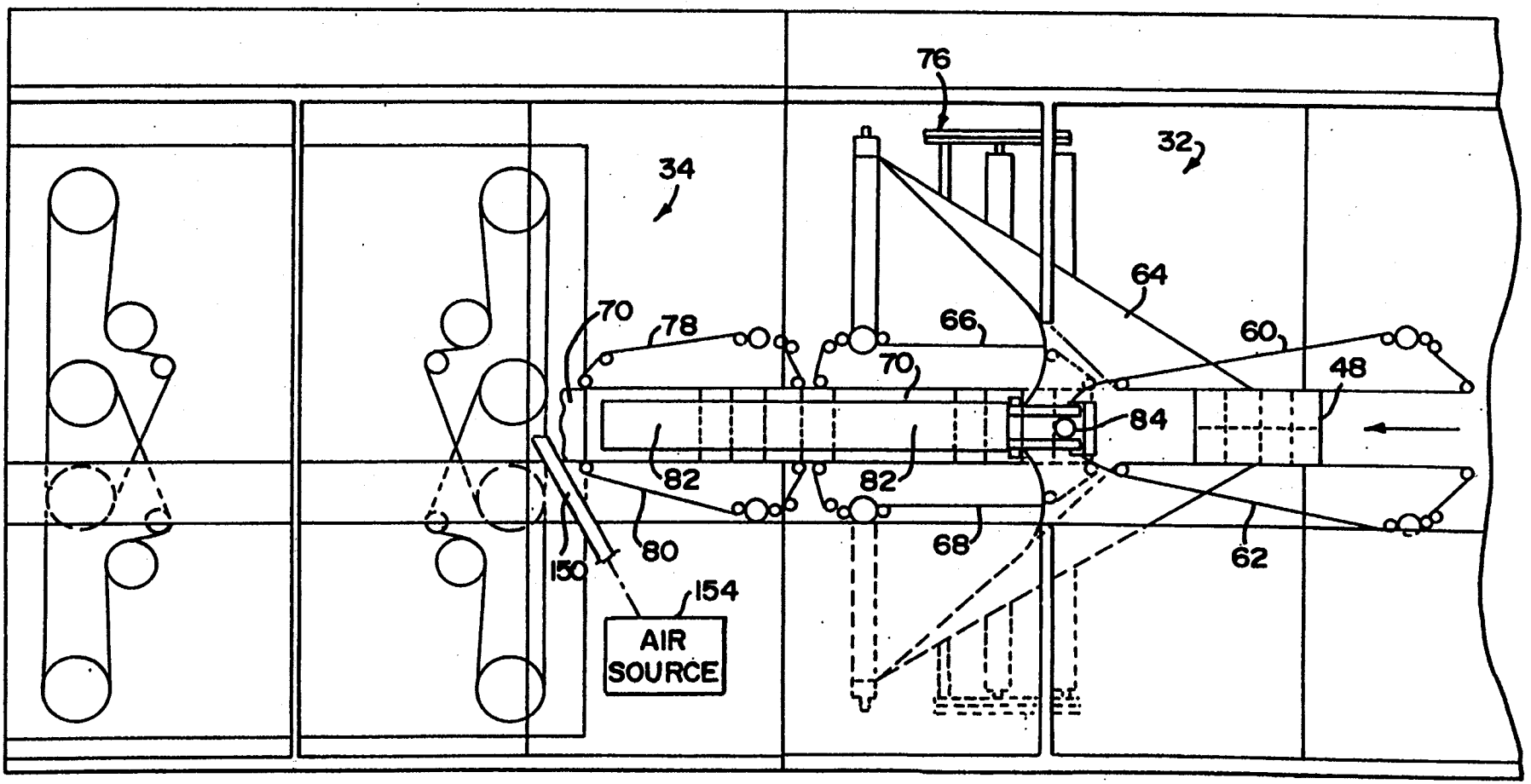
FIG. 2 is an enlarged side elevational illustration taken along lines 2—2 of FIG. 1, with portions omitted for clarity of description.

Plastic film 64 from the film handling apparatus 40 enters the forming shoulder 32, best illustrated in FIG. 3, passing over a curved form (not illustrated in detail) which forms the film 64 into a tube 70 extending between further upper and lower segmented conveyors 66 and 68. Groups 48 are transferred from the segmented conveyors 60 and 62 into the tube 70 of the film 64 between the conveyors 66 and 68, as best shown in FIGS. 2 and 3. Opposite edges of the film 64 overlap in the tube 70, and are sealed by a lap sealer 72 which preferably uses hot air to seal the overlapping portions of the film. The conveyors 60, 62, 66 and 68 are driven at the same, constant velocity, and the film enters between the conveyors 66 and 68 at the same surface velocity so that the groups 48 enter the tube 70 between the conveyors 66 and 68 at the exact surface speed of the film in order not to damage or stretch the film as the now-encapsulated group 48 is conveyed downstream within the enveloping tube 70.

The film handling apparatus 40 may be conventional. Film 64 is withdrawn from a roll 74, perforated or otherwise handled as needed, and then transmitted over a series of rollers to the forming shoulder 32. A film tension adjustment 76 shown in FIG. 2 is employed to accommodate slack in the film during start-up or shutdown of the machine 10, and in order to assure proper tension within the forming shoulder 32.

The groups 48, now encapsulated in a sealed tube 70 of the plastic film 64, exit the forming shoulder apparatus 32 into the sealing section 34 between a further pair of upper and lower conveyors 78 and 80. The conveyors 78 and 80 are driven at the same velocity as the conveyors 66 and 68, and may be segmented conveyors, or can be full width conveyors, as required.

As explained above, excess air must be withdrawn from the tube 70 before it is sealed in the sealing section 34. To this end, a conduit 82 extends longitudinally within the tube 70, terminating within the sealing section 34. The conduit preferably is flat, forming a backing for the lap sealer 72, and extending along one side of the groups 48 as they are conveyed from the forming shoulder 32 into the sealing section 34. The conduit 82 includes a nozzle 84 in the forming shoulder 32 located just upstream of where the film 64 overlaps to form the tube 70. The nozzle 84 is appropriately connected to a source of vacuum 86 illustrated in FIG. 3. The conduit 82 preferably has holes at its far left end (FIG. 2) through which air is withdrawn from the tube 70 into the conduit 82.

The sealing section 34, as described in greater detail below, includes three concatenated axes, each axis including two pairs of half dies driven in unison. Each axis comprises an upper pair of belts and a lower pair of belts. The three axes, and the elements thereof, are identified by the suffix letters A, B and C, respectively, to differentiate the three axes. Of course, the elements of the axes are the same.

Turning now to FIGS. 4–12, each axis includes a pair of upper belts 88 and 90, and a pair of lower belts 92 and 94. The four belts 88–94 of each axis are driven by a servo motor 96. Each servo motor drives a shaft 98 which has pulleys 100 and 102 at opposite ends thereof. A transmission belt 104 passes over the pulley 100, driving a pair of further pulleys 106 and 108. Similarly, a transmission belt 110 extends over the pulley 102, driving further pulleys 112 and 114. The pulleys 106 are journaled on a shaft 116 to which a pulley 118 is also journaled. Similarly, the pulley 108 is journaled on a shaft 120 to which a further pulley 122 is also journaled. In an identical fashions the pulleys 112 are journaled on a shaft 124 to which a further pulley 126 is journaled. Also, the pulleys 114 are journaled on a shaft 128 to which a further pulley 130 is journaled. All other pulleys illustrated, no matter upon which shaft they may be mounted, are mounted for free rotation. That is, all other pulleys illustrated are slave pulleys, and are not driven by a shaft, but rather are driven by one of the belts 88–94 which pass over the pulleys.

Thus, by the arrangements illustrated and described, the servo motor 96A drives the belts 88A–94A. The servo motor 96B drives the belts 88B–94B. The servo motor 96C drives the belts 88C–94C. The servo motors 96A–96C are activated by an appropriate source of electrical power (not illustrated), the driving of each of the servo motors being controlled by a motion controller in the power control 42. As will be evident from the further discussion below, the servo motors 96A–96C are operated such that spacing relationships between half dies secured to the belts 88–94 always remain the same for any given package, depending on the physical locations of the dies at any point in time during their travels with their respective belts.

In the preferred form of the invention, two sealing half dies are secured to each of the belt pairs 88 and 90, and two sealing half dies are secured to each of the belt pairs 92 and 94. Each pair of half dies together forms a die set, a typical die set 132 being shown in FIG. 12. Each die set comprises an upper half die 134 and a lower half die 136. Each pair of half dies 134 and 136 closes on the tube 70 between successive groups 48 of the items 46 being sealed, as explained in somewhat greater detail in relation to FIGS. 5–11.

Figure 12:
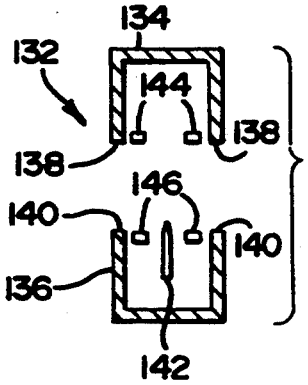
FIG. 12 is an enlarged cross sectional view of a pair of half dies.

Each of the half dies 134 and 136 includes respective gripping elements 138 and 140 illustrated in FIG. 12 which join to clamp the tube 70 therebetween when the dies 134 and 136 are closed. The gripping elements 138 and 140 extend for the respective lengths of the two half dies 134 and 136 so that the entire tube 70 is clamped therebetween when the half dies are closed.

A longitudinal mechanical knife 142 is located in the bottom die 136. The knife 142 is mounted (means not illustrated) to be activated and extend upwardly when the dies 134 and 136 are closed in order to sever the clamped tube 70. Alternatively, the knife 142 can be similarly mounted in the upper half die 134. Preferably, the knife 142 extends to a cam (not illustrated) which traverses a cam track to cause the knife 142 to rise and sever the collapsed film of the tube 70 at the appropriate time.

Each of the dies 134 and 136 also includes a respective pair of sealing ribbons 144 and 146. The sealing ribbons 144 and 146 sandwich the tube 70 therebetween when the dies 134 and 136 are closed, and are activated to heat the film and seal the respective severed ends of the tube 70. Preferably, the ribbons 144 and 146 are electrically activated to be heated and seal the film material. Additional ribbons or wires may be added to sever the film, form handles, or provide other features as desired.

As the half dies 134 and 136 close on the tube 70 between succeeding groups 48, the distance between the succeeding groups must necessarily diminish, or the film of the tube 70 must be stretched to accommodate closing of the half dies 134 and 136. Each group 48 enters the sealing section 34 at a constant velocity, and that velocity must be then reduced to avoid stretching or deformation of the film of the tube 70 as the half dies close. Therefore, the velocity each of the groups 48 is variable within the sealing section 34, with the group 48 entering at a constant velocity, then being slowed during the sealing and severing operation, and then being accelerated when departing the sealing section 34. This process is described in greater detail in relation to the description of FIGS. 5–11.

As the half dies 134 and 136 close on the tube 70, it is important that excess material of the tube, which necessarily is generated as the half dies close, be appropriately accommodated to produce an aesthetically acceptable package. Thus, as the half dies 134 and 136 close, blasts of air are directed at opposite sides of the tube 70 through opposite air nozzles 148 and 150 shown in FIGS. 1 and 2. The blasts of air form gussets as the half dies 134 and 136 close. The nozzles 148 and 150 are connected to an air tube 152 which leads to a remote source 154 of pressurized air which is also controlled by the central motion controller located in the panel 42.

As explained above, it is preferred that two die sets 132 be associated with each axis of the sealing section 34. An axis comprises one of the servo motors 96, and the related belts and pulleys driven by that servo motor. With two die sets 132 being connected to each axis, the half dies 134 and 136 of each die set are connected to the respective belts 88, 90 and 92, 94 so that the half dies close on the tube 70 at the appropriate time. The die sets 132 of each axis are 180° apart—that is, the half dies of the two die sets are mounted such that they are diametrically opposite one another.

FIGS. 5–11 track movement of the six die sets 132 (two per axis) through a portion of a sealing cycle. Each of the half dies illustrated in FIGS. 5–11 is identified in relation to its axis in the same fashion as FIG. 4. That is, the first axis has been designated with the letter "A", the second axis has been designated with the letter "B", and the third axis has been designated with the letter "C". In addition, the first die set of each axis has been designated with the letter 1, while the second die set of each axis has been designated by the letter 2. Therefore, the first die set of the first axis is composed of an upper half die 134A1 and a lower half die 136A1. The second die set of that axis is identified by the upper half die 134A2 and the lower half die 136A2. Similar designations are applied to the die sets of the additional two axes. Because the three axes are coaxial, in the schematics of FIGS. 5–11, the upper belts 88 and 90 are shown superimposed on one another, and similarly the lower belts 92 and 94 are shown superimposed on one another.

Figure 5:
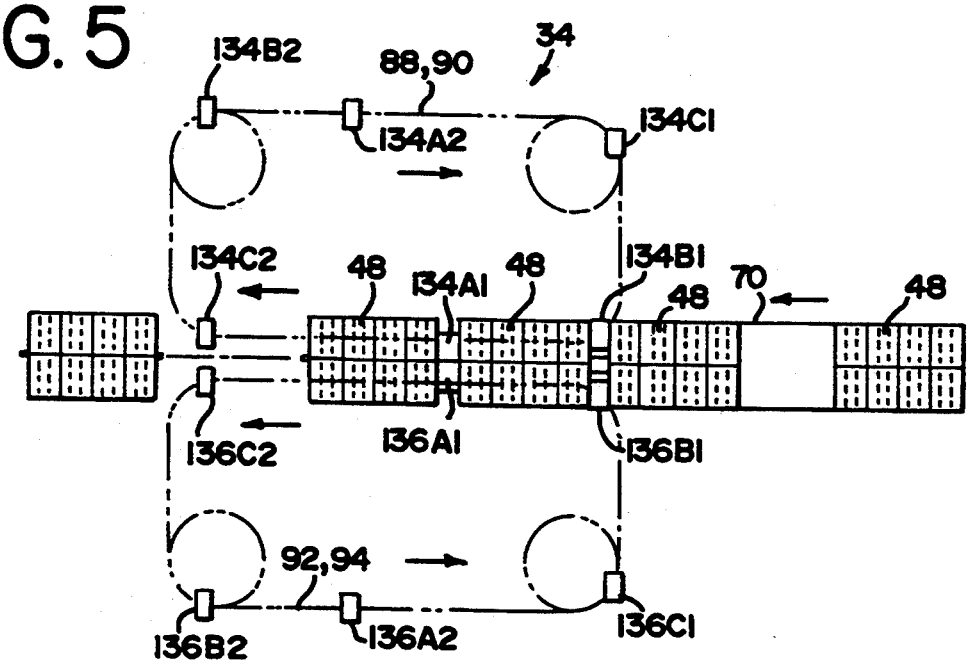
FIG. 5 is a schematic side elevational illustration of the sealing system showing the sequence of sealing, with the die sets of the three axes being located at selected positions in their paths of travel.
Figure 6:
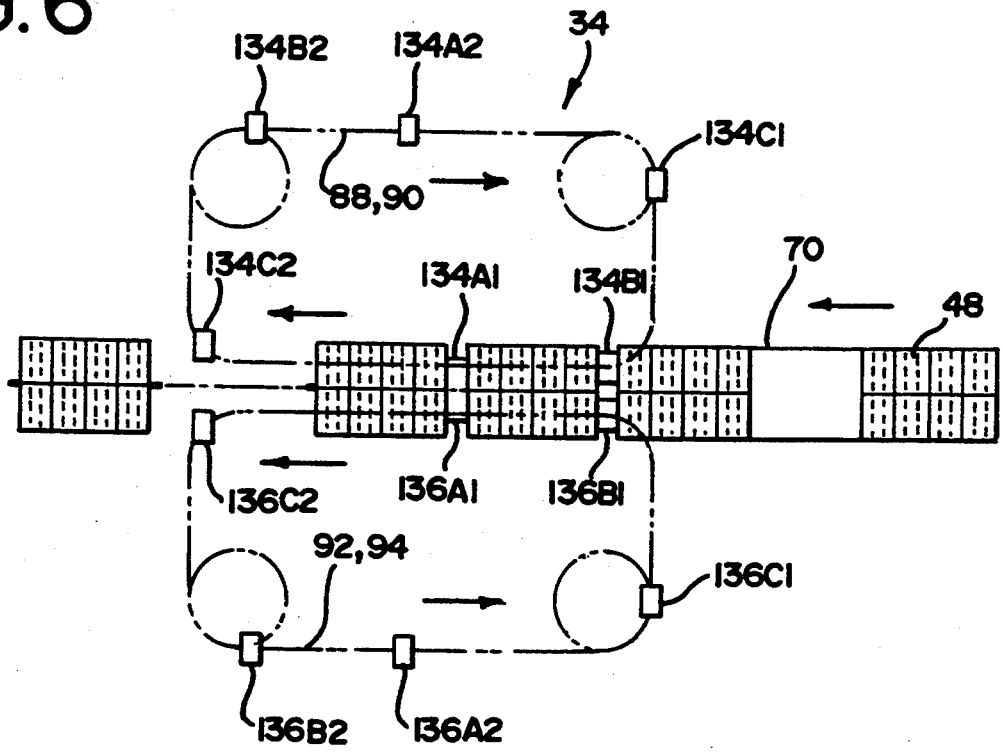
FIGS. 6–11 illustrate the die sets as they advance successively in their travel, with FIG. 11 being identical to FIG. 5 but with the die sets having advanced one full package position.
Figure 7:
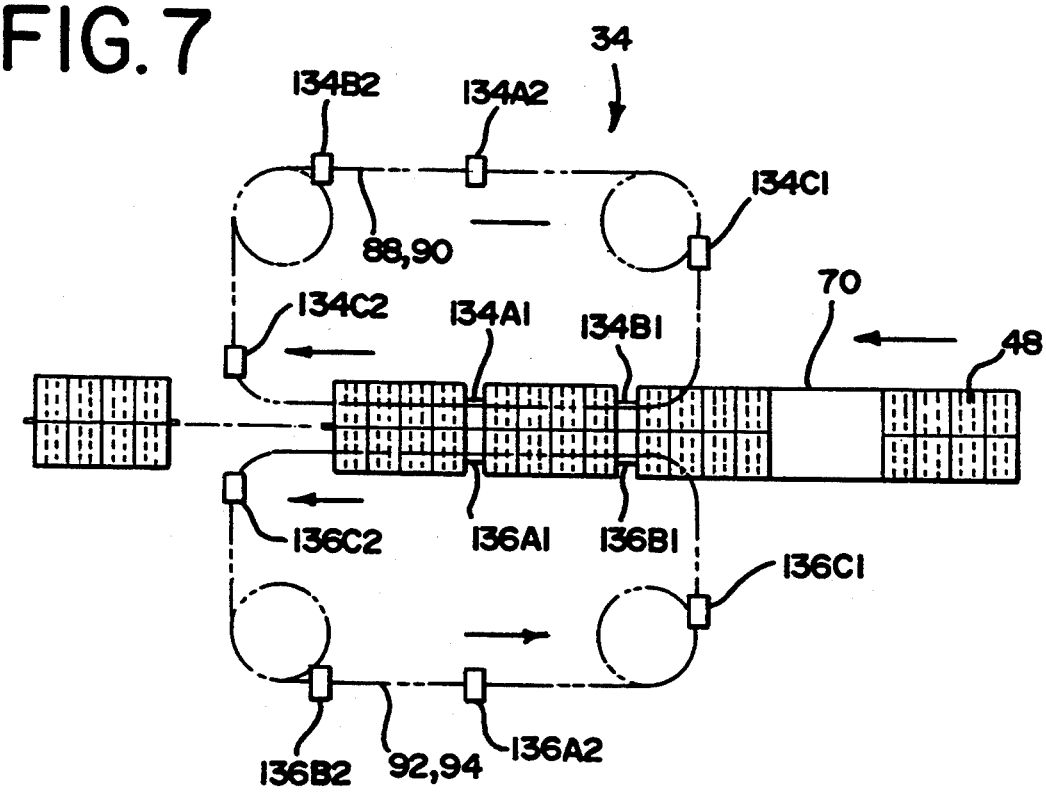
Figure 8:
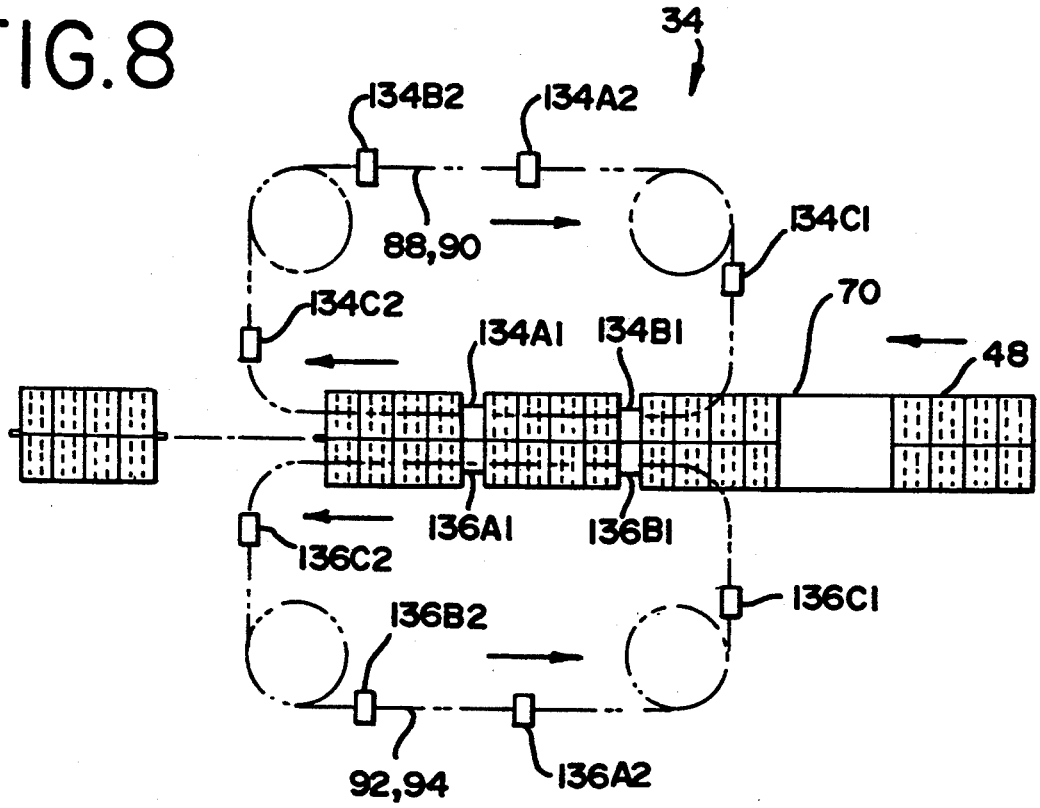
Figure 9:
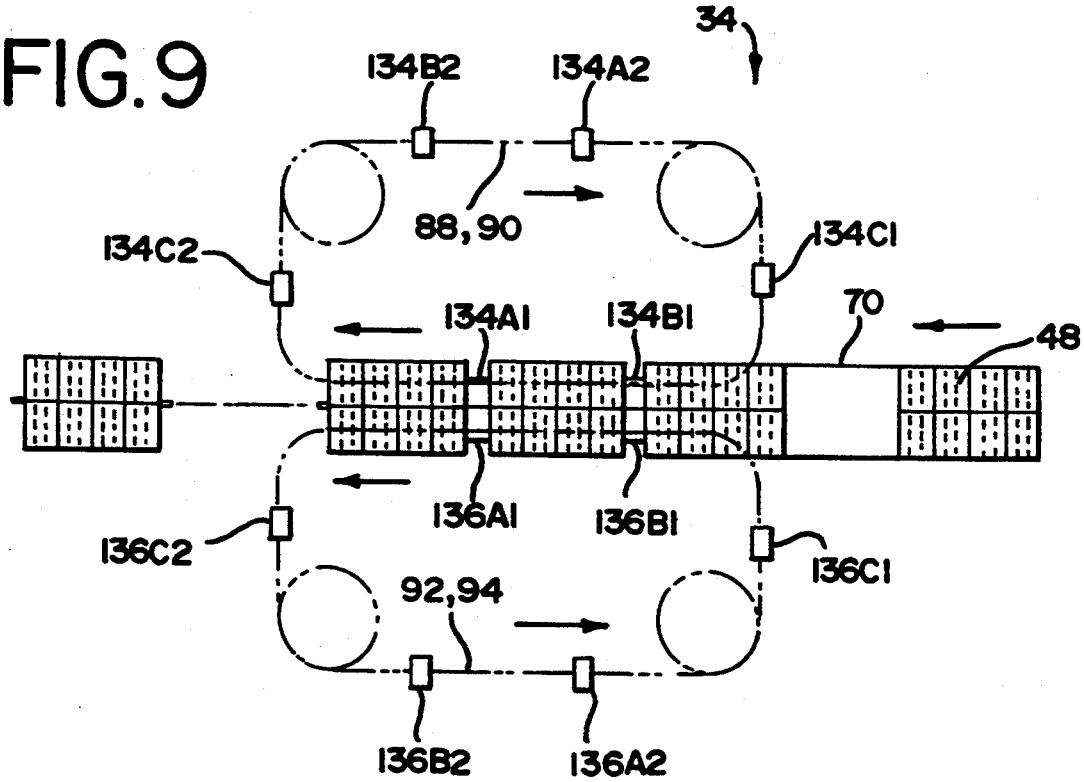
Figure 10:
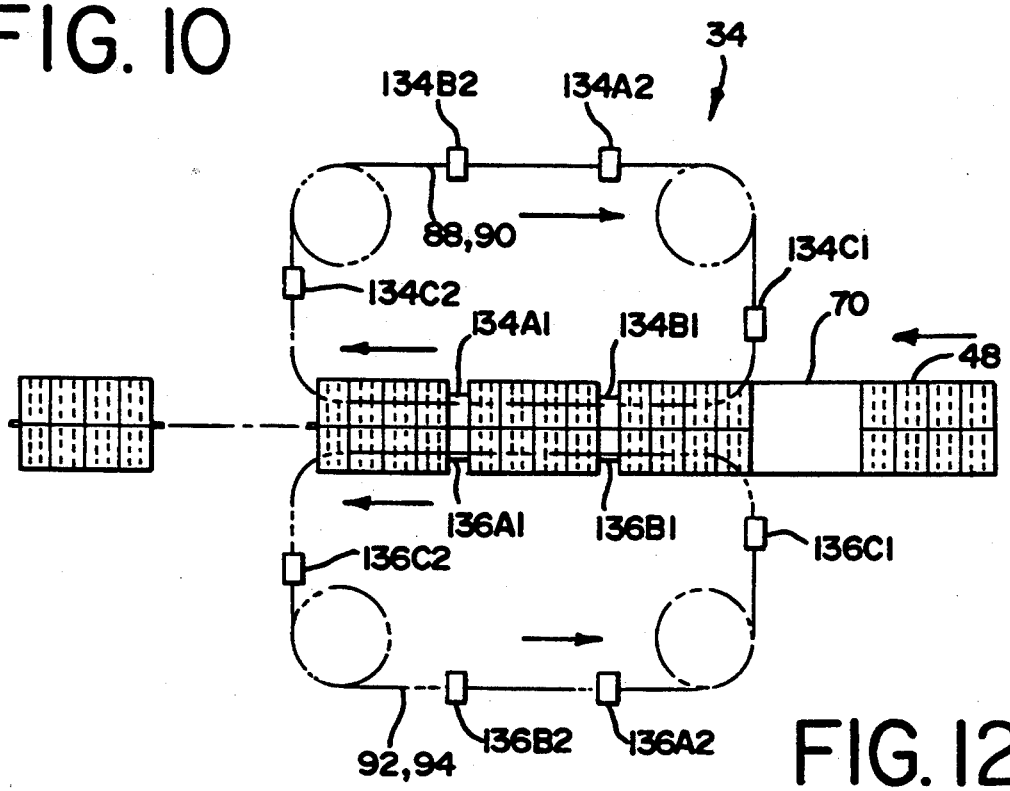
Figure 11:
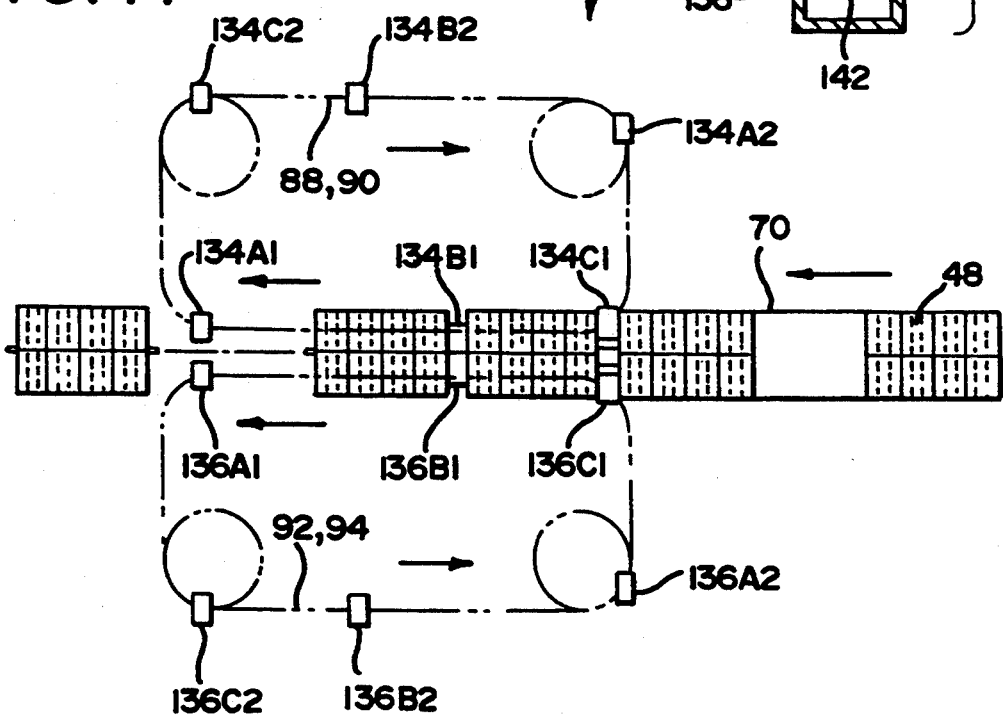

FIGS. 5–11 illustrate the relative positions of the die sets of each of the three sealing axes at various positions. It will be obvious that as the belts of the axes are rotated, the same functions are performed by succeeding die sets as the die sets progress through their paths of travel. Thus, FIGS. 5 and 11 are identical, except that each die set has progressed one full position. Referring to FIGS. 5 and 11, it will be seen that the die set comprising the half dies 134A1 and 136A1 have progressed in FIG. 11 to the position formerly occupied by the die set comprising the upper half die 134C2 and the lower half die 136C2. The remaining die sets have also progressed accordingly.

Figure 13:
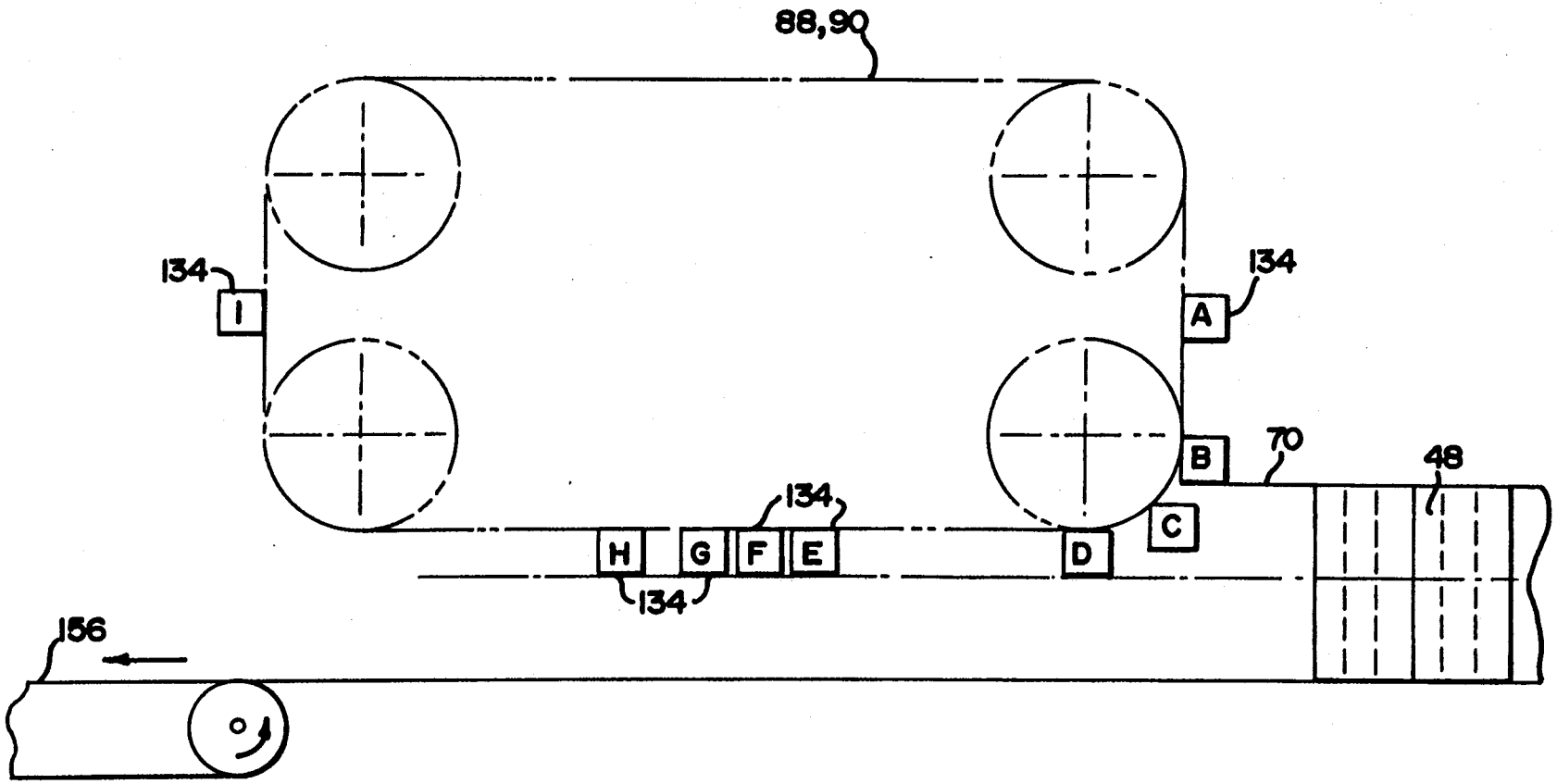
FIG. 13 illustrates various positions of one die half of a die set as it advances through 180° of travel.
Figure 14:
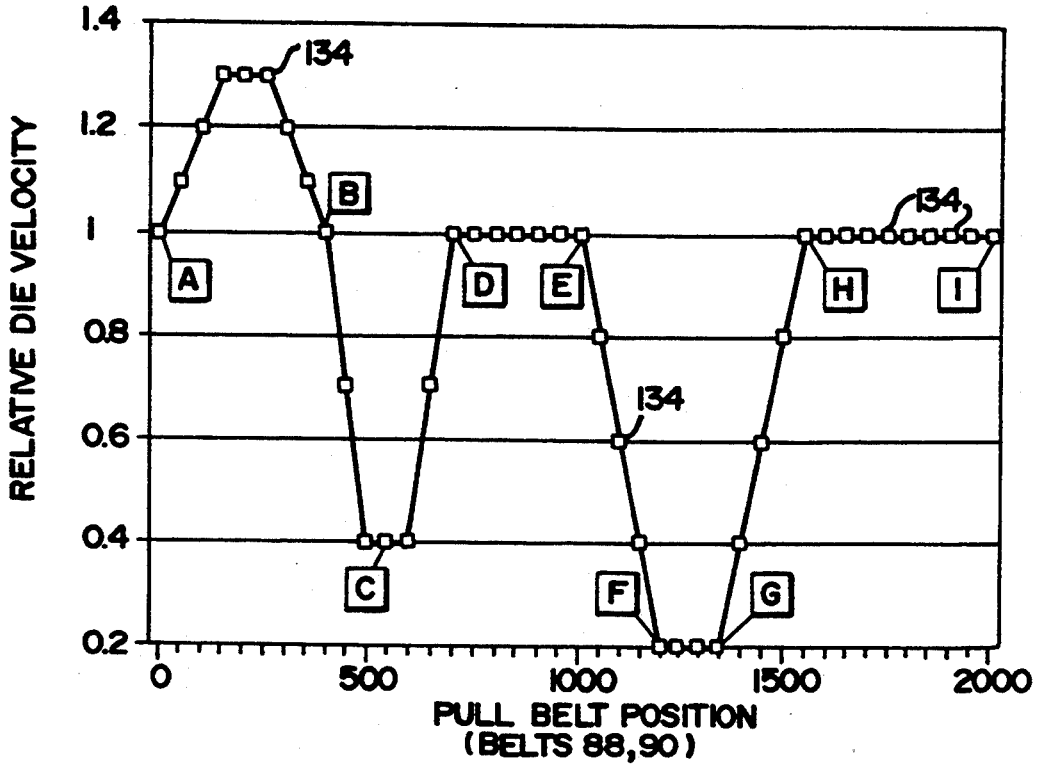
FIG. 14 is a graph illustrating velocity of the half die of FIG. 13 relative to the velocity of the enveloping film as it enters the sealing section.
Figure 15:
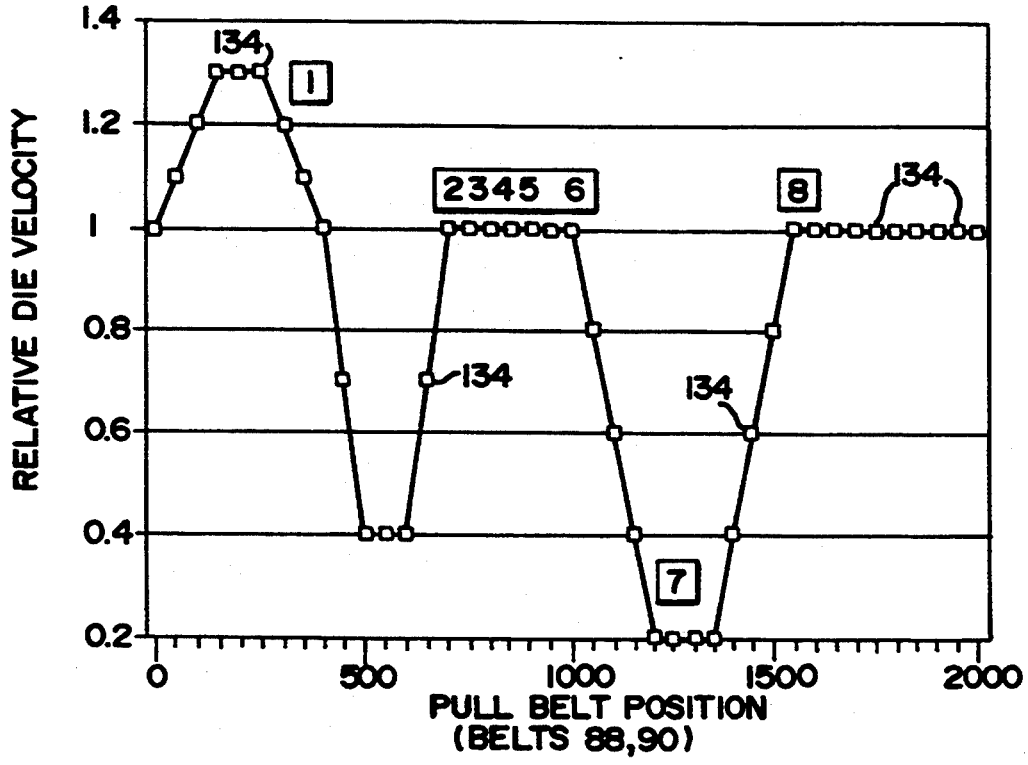
FIG. 15 is a graph identical to FIG. 14, but illustrating where various processing functions of the sealing system occur.

Referring now to FIGS. 13–15, the processing sequence will be described in greater detail in relation to the travel of an upper half die 134 of a single die set through 180° of travel. It is obvious that the corresponding lower half die of the die set, which has not been illustrated, would track the movement of the upper half die 134 precisely, as explained above. Also, of course, there are two or more axes employed by the invention, superimposed on one another in the fashion shown in FIGS. 4–11. The die sets of each axis will behave in an identical fashion to the half die 134 about to be described. The dies of the further die sets are simply out of phase, but follow the sequence of the upper half die 134 exactly.

As the half die 134 progresses, its various positions illustrated in FIG. 13 are identified by the letters A–I. At a starting point A, the half die 134 which is connected between the belts 88 and 90 begins to be accelerated by its associated servo motor 96 (FIG. 4) to meet the film of the tube 70. At position B, the upper half die 134 has contacted the tube 70 as shown. The half die 134 then begins to collapse the film 64 as it is compressed between the upper and lower half dies. By the time that the half die 134 has reached position B, the air source 154 shown in FIG. 2 has been activated, causing air from the nozzles 148 and 150 to impinge against the opposite sides of the tube 70, forming the gussets as the tube is collapsed between the half dies.

At position C, the half die 134 reaches a transition point, where it changes its travel from a generally vertical direction to a generally horizontal direction for the duration of the film processing cycle. As explained below, the horizontal speed of the half die 134 must be compensated so that it is equal to the horizontal velocity of the film of the tube 70. If that were not true, there would be either stretching of the film of the tube 70, or interference between the dies of the die set and the items being packaged.

At position D, the half die 134 has completed its vertical component of travel, and must now proceed forwardly at the same velocity as the travelling film of the tube 70. At position D, the upper half die 134 and its mating lower half die 136 are fully closed, clamping the collapsed tube between the gripping elements 138 and 140 (FIG. 12). If the belts 88, 90 (and corresponding belts 92, 94) are not sufficiently strong to clamp the upper half die 134 and lower half die 136 with sufficient force, additional means can be provided to clamp the half dies together. For example, the half dies 134 and 136 may include cams at their opposite ends, which traverse cam tracks provided between positions D and F. Other means of forcing the half dies together can be employed, if needed.

Between positions D and E, the film of the tube 70 is cut by the knife 142 (FIG. 12) and is sealed by the sealing ribbons 144 and 146. The knife 142 can be cam operated or can be in the form of a hot wire contained in the dies (means not shown) in a conventional fashion to sever the film, and the sealing ribbons 144 and 146 can be electrically activated in a conventional fashion, such as by having contacts traversing electrically-activated busbars (not illustrated), also in a conventional fashion.

By the time that the half die 134 reaches position E, the film of the tube 70 has been cut and sealed, and the horizontal velocity of the half die 134 must be reduced in order to permit the next succeeding half die, which would be in position B, to begin forming of the gusset on the opposite side of the group of items 46 being sealed. The deceleration of the half die 134 continues between the positions E and F.

The plastic film of the tube 70 is preferably polyethylene, or another similar plastic. Since the plastic film has just been heat sealed between the sealing ribbons 144 and 146, it must now be cooled in order to retain sufficient seal integrity. At position F, the half die 134 (and the corresponding lower half die 136) is opened or cracked slightly from the collapsed film to allow cooling air to be forced into the seal area. Cooling continues between positions F and G.

At the position G, acceleration of the half die 134 is necessary to match the velocity of the next succeeding upper half die 134, which would be in position D. Acceleration continues between positions G and H.

At position H, the upper half die 134 and lower half die 136 are opened, and the group 48 which is now partially located on an exit conveyor 156, is accelerated by the conveyor 156 and quickly exits the sealing section 34. The half die 134 then continues to move to position I, which is 180° diametrically opposite from the starting position A. If there are two die sets on the axis, the second die set would be at position A when the first die set is at position I. The process then continues for that die set in precisely the manner described above.

FIG. 14 shows the relative velocities described in the sealing process explained in relation to FIG. 13. For the sake of description, the belts 88 and 90 are defined as having 4000 units of length, with the belts therefore between positions A and I having half that length, or 2000 units. Those units are shown on the horizontal axis in FIG. 14. The vertical axis represents the relative die velocity, which is the velocity of the dies of the half dies 134 (and half dies 136) in relation to the velocity of the film of the tube 70 as it enters the sealing section 34. As explained above, the velocity of the tube 70 is constant as it enters the sealing section 34. If the velocity of the dies matches that of the film, the relative die velocity is one. If the die velocity is slower than that of the film, the relative die velocity is less than one, and conversely, if the velocity of the dies is greater than the film velocity, the relative die velocity is greater than one. Also, positions A–I of the upper half die 134 as illustrated in FIG. 13 are also indicated in FIG. 14.

As can be seen, between positions A and B, the half dies are first accelerated, and then decelerated to match the film velocity. As the film is collapsed between the half dies between positions B and D, the relative die velocity decreases, and then increases to unity. Between positions D and E, the relative die velocity is unity, but after position E, the relative die velocity again decreases to position F, where it remains constant between positions F and G. Then, the relative die velocity is increased to position H, where the dies open to allow the now-sealed package to be released.

FIG. 15 illustrates a graph identical to FIG. 14, but simply eliminating the positions A–I for the sake of clarity, and instead showing, with numbers 1–8, where various functions of the processing axis take place. At position 1, the air source 154 for forming the gussets is activated. At position 2, that air source is deactivated, upon completion of the gussets as the die set has been closed. At position 3, the knife 142 is activated to sever the film between the sealing ribbons. At position 4, the knife is retracted.

Sealing begins at position 5. The sealing ribbons 144 and 146 are activated at this position, and remain activated until position 6. In a typical sealing cycle, the dwell time between positions 5 and 6 is about 400 milliseconds.

At position 7, the dies have been cracked, and cooling air, from a source not illustrated, impinges on the sealed film to cool the molten seal. Cooling continues between positions 7 and 8, where the cooling air is disabled and, as explained above, the dies are fully opened to allow the now-sealed package to exit on the conveyor 156 (FIG. 1).

The apparatus illustrated can be utilized to seal packages of varying heights and lengths. The only variable for different package lengths are the positions E, F and G of FIG. 13. For shorter package lengths, positions E, F and G would move to the right in FIG. 13, while for longer package lengths, the positions E, F and G would move to the left. All other positions would remain the same.

Various changes can be made to the invention without departing from the spirit thereof or scope of the following claims.

What is claimed is:

1. In an apparatus for packaging items and processing plastic film between successive items, a multi axis system comprising at least two coextensive processing axes, each axis having at least one die set and each axis having means for independently driving the axis at a variable velocity such that the velocity of the axes relative to one another may be changed during a package making cycle without one die set interfering with any other die set.

2. An apparatus according to claim 1, including at least one additional die set per processing axis.

3. An apparatus according to claims 2, in which the die sets of each axis are spaced equidistant from one another.

4. An apparatus according to claim 1, in which each die set comprises two opposing half dies, each half die being fully separable from the other half die, and in which said driving means for each processing axis comprises two pairs of belts, one pair of said belts being drivingly connected to one half die of said die set and the other pair of said belts being drivingly connected to the other half die of said die set, and including transmission means for driving all belts of a processing axis in unison.

5. An apparatus according to claim 4, including a first rotatable shaft interlinking one of said belt pairs and a second rotatable shaft interlinking the other of said belt pairs, and in which said transmission means comprises a propulsion belt drivingly engaged on said shafts.

6. An apparatus according to claim 1, including three processing axes, and including means synchronizing said axes such that the die sets of said processing axes are concatenated and are spaced a predetermined distance during processing.

7. An apparatus according to claim 1, in which said film is in an elongated sheet, and including means for forming said film into a tube in a path of travel of said items.

8. An apparatus according to claim 7, in which said forming means comprises a forming shoulder extending about said path of travel, and including means for inserting items into said tube.

9. An apparatus according to claim 8, in which said inserting means comprises a series of separate, drivingly interconnected endless parallel belts.

10. An apparatus according to claim 9, in which said belts have lengths to conform to the shape of said forming shoulder.

11. An apparatus according to claim 7, in which said tube is formed with a longitudinal lap of said film, and including means for sealing said longitudinal lap.

12. An apparatus according to claim 11, in which said means for sealing comprises a source of hot air positioned adjacent the longitudinal lap.

13. An apparatus according to claim 7, including means for tucking the film of said tube to form gussets between items as half dies of said die set close on said tube.

14. An apparatus according to claim 13, in which said means for tucking is located on opposite sides of said tube.

15. An apparatus according to claim 14, in which said means for tucking includes an air nozzle on each of opposite sides of said tube, each nozzle being directed toward said tube and including means for directing air through said nozzles as half dies of each die set close.

16. An apparatus according to claim 7, including means for reducing the volume of air in said tube.

17. An apparatus according to claim 16, in which said means for reducing comprises a conduit extending within said tube and having an inlet at one end in said tube, and including a vacuum source connected to said conduit.

18. An apparatus according to claim 1, in which each die set comprises two opposing half dies extending laterally across said plastic film.

19. An apparatus according to claim 18, in which each half die includes spaced means for clamping said plastic film and sealing means which extend across said film.

20. An apparatus according to claim 19, in which one of said half dies includes means for severing said film when closed between said half dies.

21. An apparatus according to claim 19, in which said half dies include means for forming a handle in said plastic film.

22. In an apparatus for packaging items and sealing plastic film between successive items, a multi axis system comprising at least two coextensive processing axes with each axis having at least one die set, and including means for synchronizing said axes such that said die set of said processing axes are concatenated and are spaced a required distance during processing.

23. An apparatus according to claim 22, in which the die sets of each axis are spaced equidistant from one another.

24. An apparatus according to claim 22, in which said means for synchronizing said axes includes means for driving each processing axis independent of each other processing axis.

25. An apparatus according to claim 24, in which each die set comprises two opposing half dies, each half die being fully separable from the other half die, and in which said driving means for each sealing axis comprises two pairs of belts, one pair of said belts being drivingly connected to one half die of said die set and the other pair of said belts being drivingly connected to the other half die of said die set, and including transmission means for driving all belts of a processing axis in unison.

26. An apparatus according to claim 25, including a first rotatable shaft interlinking one of said belt pairs and a second rotatable shaft interlinking the other of said belt pairs, and in which said transmission means comprises a propulsion belt drivingly engaged on said shafts.

27. An apparatus according to claim 22, in which each die set comprises two opposing half dies extending laterally across said plastic film.

28. An apparatus according to claim 27, in which each half die includes spaced means for clamping said plastic film and sealing means which extend across said film.

29. An apparatus according to claim 28, in which one of said half dies includes means for severing said film when closed between said half dies.

30. An apparatus according to claim 28, in which said half dies include means for forming a handle in said plastic film.

31. A plastic film closing and processing system for handling at least two items traversing a linear path, comprising a. a plastic film for bridging said items, b. an infeed section and a downstream processing section through which said items and film pass, said processing section having an inlet end, c. means at said inlet end for collapsing said plastic film between said items, d. means for driving said film with said items at a constant velocity in said infeed section, and e. means for propelling said film with said items at a variable velocity in said processing section.

32. A film closing and processing system according to claim 31, in which said collapsing means comprises a series of spaced die sets.

33. A film closing and processing system according to claim 32, in which said die set comprises two opposing half dies extending laterally across said plastic film.

34. A film closing and processing system according to claim 33, in which each half die includes spaced means for clamping said plastic film and sealing means which extend across said film.

35. A film closing and processing system according to claim 34, in which one of said half dies includes means for severing said film when closed between said half dies.

36. A film closing and processing system according to claim 35, in which said half dies include means for forming a handle in said plastic film.

37. A film closing and processing system according to claim 31, in which said film is in an elongated sheet, and including means for forming said film into a tube in said linear path.

38. A film closing and processing system according to claim 37, in which said driving means comprises a series of separate, drivingly interconnected endless parallel belts, said belts being driven at a constant surface velocity.

39. A film closing and processing system according to claim 31, including at least two processing axes in said processing section, each processing axis having at least one die set and each die set being in constant contact with the film between items during sealing.

40. A film closing and processing system according to claim 39, in which the die sets of each axis are spaced equidistant from one another.

41. A film closing and processing system according to claim 40, in which said propelling means comprises means for separately driving each processing axis independent of each other sealing axis.

42. A film closing and processing system according to claim 41, in which each die set comprises two opposing half dies, each half die being fully separable from the other half die, and in which said separate driving means for each processing axis comprises two pairs of belts, one pair of said belts being drivingly connected to one half die of said die set and the other pair of said belts being drivingly connected to the other half die of said die set, and including transmission means for driving all belts of a processing axis in unison.

43. A film closing and processing system according to claim 42, including a first rotatable shaft interlinking one of said belt pairs and a second rotatable shaft interlinking the other of said belt pairs, and in which said transmission means comprises a propulsion belt drivingly engaged on said shafts.

44. A film closing and processing system according to claim 39, including three processing axes, and including means synchronizing said axes such that the die sets of said processing axes are concatenated and are spaced a predetermined distance during sealing.

* * * * *